US007213527B2

(12) United States Patent
Bernard

(10) Patent No.: US 7,213,527 B2
(45) Date of Patent: May 8, 2007

(54) FOLDING PONTOON TRAILER FOR ALL-TERRAIN VEHICLE

(76) Inventor: Pierre Bernard, 1250, 7e Rang C.P. 479, St-Cyrille (CA) J1Z 1N3

( * ) Notice: Subject to any disclaimer, the term of this patent is extended or adjusted under 35 U.S.C. 154(b) by 0 days.

(21) Appl. No.: 11/362,904

(22) Filed: Feb. 28, 2006

(65) Prior Publication Data

US 2006/0191455 A1 Aug. 31, 2006

(30) Foreign Application Priority Data

Feb. 28, 2005 (GB) ..... 0504041.5

(51) Int. Cl.
*B63B 1/00* (2006.01)

(52) U.S. Cl. ..... 114/61.15; 114/353

(58) Field of Classification Search ..... 114/353, 114/61.15

See application file for complete search history.

(56) References Cited

U.S. PATENT DOCUMENTS 5,870,966 A * 2/1999 Christian ..... 114/353
6,095,079 A * 8/2000 Smidt ..... 114/353
6,564,735 B1 * 5/2003 Jackson ..... 114/61.1

* cited by examiner

*Primary Examiner*—Stephen Avila

(57) ABSTRACT

A pontoon usable for supporting a load, the pontoon being towable on land and usable on water to support the load thereonto. The pontoon includes a hinge; a first platform attached to the hinge, said first platform including a first substantially buoyant body extending therefrom; a second platform attached to said hinge so that the first and second platforms are hingedly attached to each other, the second platform including a second substantially buoyant body extending therefrom; a first and a second wheel respectively reversibly attachable to the first and second platforms respectively substantially adjacent the first and second buoyant bodies; the first and second platforms being movable between a deployed configuration and a folded configuration wherein in the folded configuration, the pontoon is usable on water to support the load and in the folded configuration, the pontoon is towable on land.

15 Claims, 4 Drawing Sheets

34
38
40
44
14
20
36
56
58
104
106
48
108
62
64
66
60

FOLDING PONTOON TRAILER FOR ALL-TERRAIN VEHICLE

This Application claims priority from UK Patent Application Serial Number 0504041.5 filed on Feb. 28, 2005

FIELD OF THE INVENTION

The present invention relates to general field of vehicle accessories, and is particularly concerned with a folding pontoon trailer.

BACKGROUND OF THE INVENTION

Recreational all-terrain vehicles, also commonly referred to as ATVs, have achieved a substantial popularity during the past few years. These types of vehicles are indeed very practical and versatile since they may be used for work or leisure related tasks.

By virtue of their relatively compact nature, their great mobility and their traction, they are capable of moving over many types of surfaces, from the common backyard to more challenging off the road terrain. Since ATVs are also fairly powerful, these vehicles may be used to pull or push various objects, such as a trailer.

In order to accommodate off road use, ATVs typically have over sized, soft and heavy threaded tires which are designed for non-pavement surfaces. The tires are typically mounted to a robust, steel frame through heavy-duty shock absorbers. A powerful gas-powered engine is provided for driving the tires. Also, typically, the tires are spaced apart to cast a wide swath and the frame is generally low in order to improve stability of the vehicle.

ATVs are often called upon by outdoorsman, such as hunters, fishermen, campers and the like, to carry not only passengers, but also gear. One of the main drawbacks associated with conventional ATVs relates to the fact that they are typically only intended for use for one or two individuals, namely a driver and in some instances a passenger. Hence, in situations wherein gear needs to be carried from one location to another, conventional ATV owners must resort to making a substantial amount of trips in order to carry the equipment. This may prove to be both tedious and time consuming, especially in off-road conditions.

Although most conventional ATVs are provided with both front and rear carrying racks, this is nevertheless considered inadequate. The volume of gear or equipment attachable to such a carrying rack is often insufficient. For example, during a typical weekend camping expedition, an intended user may require numerous pieces of equipment that may not fit on such racks. Furthermore, conventional racks are totally inadequate for transportation of additional passengers.

The problem of insufficient carrying accommodations on ATVs has been addressed in so much as ATVs commonly are equipped with a rearwardly disposed towing tongue assembly, which is attachable to a standard trailer hitch. Heretofore, trailers used with ATVs generally have two wheels mounted to a frame with an open, rear bed.

These trailers typically, though, are not sufficiently adapted for use in all off-road environments traversable by the ATV itself. In this regard, ATVs are often used in relatively rugged terrain and, for example, are capable of climbing over rather large obstacles. Trailers, on the other hand, generally are not suited for such use and may become stuck. Trailers, for example, commonly have an axle extending between the wheels. This axle, however, is prone to catch on logs, stumps, rocks, or other obstacles while the trailer is driven off-road. In other terrain, for instance, the ATV and trailer may be required to pass through the mud or between relatively close trees. In these situations, if the trailer is too large or difficult to pull, both may become stuck.

A relatively common problem when using ATVs for outdoor expeditions, such as camping or fishing, is due to the fact that ATVs are often unable to carry a boat along. Conventional ATV trailers are simply not adapted to carrying such a bulky load. Indeed, heretofore trailers for transporting boats and water recreational vehicles are of such size and weight to be such considered impractical for use with ATVs.

Notwithstanding the weight of the boat and trailer combination, the mere width of the boat and trailer combination would greatly reduce the capacity of the ATV to travel in some popular off-road locations such as in a relatively thick forest. For example, in situations wherein the ATV needs to travel between relatively adjacent trees, the mere width of conventional boats and trailers would result in the latter being caught between the trees.

Hence, participation in camping and water recreation has been directed in one or two directions. Typically, hunters and fishermen arrive at their destination with their ATVs and are at the mercy of marinas for relatively expensive canoe rentals, if available. The alternative is possibly to have one of the passengers drive a full size car or pick-up to tow their large, heavier trailers to participate in their water recreation. However, this may prove impossible in some situations since, by definition, some larger cars or vehicles may not be able to reach the destination reached by ATVs.

Furthermore, one of the problems associated with conventional boats and trailers is that a typical boat adapted to be carried by trailers towable by ATVs is unable to carry the ATVs itself across the body of water. Hence, the intended user must resort either to traveling around the body of water or being deprived of the ATV for the continuation of the expedition. This greatly limits the possibility for the ATV owner to plan more elaborate expeditions.

Hence, it would be desirable to provide a solution offering the freedom of using an ATV for transporting a boat or water recreational vehicle on off-road terrain. It is also desirable to provide a trailer that can be used as a watercraft that can be motorized, towed or otherwise propelled on the body of water. It is further desirable to provide such a trailer that can be used itself as a watercraft for carrying the ATV across the body of water. Accordingly, there exists a need for a folding pontoon trailer for all-terrain vehicles and by attaching many pontoons for forming a mobile bridge.

It is a general object of the present invention to provide such a folding pontoon trailer for all-terrain vehicles.

SUMMARY OF THE INVENTION

In a first broad aspect, the invention provides a pontoon usable for supporting a load, said pontoon being towable on land and usable on water to support the load thereonto, said pontoon comprising:

a first platform including a first platform supporting surface, a first platform buoyant body attachment surface substantially opposed to said first platform supporting surface, a first platform first end edge, a first platform second end edge substantially opposed to said first platform first end edge, a first platform first lateral edge extending between said first platform first and second end edges and a first platform second lateral edge substantially opposed to said first platform first lateral edge and extending between said first platform first and second end edges, said first platform first and second end edges and said first platform first and second lateral edges being located substantially peripherally relatively to said first platform supporting and buoyant body attachment surfaces, said first platform further including a first substantially buoyant body extending substantially outwardly from said first platform buoyant body attachment surface and located substantially adjacent to said first platform second lateral edge, said first buoyant body defining a first buoyant body outwardmost location;

a second platform including a second platform supporting surface, a second platform buoyant body attachment surface substantially opposed to said second platform supporting surface, a second platform first end edge, a second platform second end edge substantially opposed to said second platform first end edge, a second platform first lateral edge extending between said second platform first and second end edges and a second platform second lateral edge substantially opposed to said second platform first lateral edge and extending between said second platform first and second end edges, said second platform first and second end edges and said second platform first and second lateral edges being located substantially peripherally relatively to said second platform supporting and buoyant body attachment surfaces, said second platform further including a second substantially buoyant body extending substantially outwardly from said second platform buoyant body attachment surface and located substantially adjacent to said second platform second lateral edge, said second buoyant body defining a second buoyant body outwardmost location, said first and second platform being hingedly attached to each other at locations respectively substantially adjacent said first and second platform first lateral edge;

a first and a second wheel respectively reversibly attachable to said first and second platforms respectively substantially adjacent said first and second platform second lateral edges;

said first and second platforms being movable between a deployed configuration and a folded configuration, wherein in said deployed configuration, said first and second wheels are detached from respectively said first and second platforms and said first and second platforms are substantially coplanar relatively to each other so as to be usable on water to support the load onto the first and second platform supporting surfaces; and in said folded configuration, said first platform supporting surface is substantially facing said second platform supporting surface and said first and second wheels are respectively attached to said first and second platforms so that said pontoon is towable on land.

Advantages of the present invention include that the pontoon trailer is adapted to be towed by conventional all-terrain vehicles. The proposed pontoon trailer is hence adapted to be attached to, and detached from, conventional all-terrain vehicles through a set of quick and ergonomic steps without requiring special tooling or manual dexterity and without requiring major modification to conventional all-terrain vehicles.

Also, the proposed pontoon trailer is designed so as to be adapted for use in off-road environments and, in particular, adapted to be pulled in relatively deep or thick forest environments wherein trees are relatively close to one another. The proposed pontoon trailer is also designed so as to be towable on relatively rugged terrain with reduced risk of becoming stuck or tipped.

The proposed pontoon trailer is adapted to be foldable in order to be compact when pulled on outdoor terrain. The pontoon trailer is designed so as to foldable and deployable through a set of quick and ergonomic steps, again without requiring special tooling or manual dexterity.

Furthermore, the proposed pontoon trailer is designed so as to provide a relatively safe and stable watercraft when in a deployed state, the watercraft being able to be motorized, towed or otherwise propelled on a body of water. Furthermore, the watercraft is designed so as to be able to carry the ATV itself across the body of water.

Yet still furthermore, the proposed folding pontoon trailer is designed so as to be manufacturable using conventional forms of manufacturing and conventional components so as to provide a trailer that will be economically feasible, long-lasting and relatively trouble-free in operation.

Synergetic effects between the configuration and positioning of the wheels and of the buoyant bodies create a pontoon that is both relatively stable both while used on water to support a load and while being towed on land.

In another broad aspect, the invention provides a pontoon usable for supporting a load, said pontoon being towable on land and usable on water to support the load thereonto, said pontoon comprising:

a hinge;

a first platform attached to said hinge, said first platform including a first platform supporting surface, a first platform buoyant body attachment surface substantially opposed to said first platform supporting surface and a first substantially buoyant body extending from said first platform buoyant body attachment surface substantially distally relative to said hinge;

a second platform attached to said hinge so that said first and second platforms are hingedly attached to each other, said second platform including a second platform supporting surface, a second platform buoyant body attachment surface substantially opposed to said second platform supporting surface and a second substantially buoyant body extending from said second platform buoyant body attachment surface substantially distally from said hinge;

a first and a second wheel respectively reversibly attachable to said first and second platforms respectively substantially adjacent said first and second buoyant bodies;

said first and second platforms being movable between a deployed configuration and a folded configuration, wherein in said deployed configuration, said first and second wheels are detached from respectively said first and second platforms and said first and second platforms are substantially coplanar relatively to each other so as to be usable on water to support the load onto the first and second platform supporting surfaces; and in said folded configuration, said first platform supporting surface is substantially facing said second platform supporting surface and said first and second wheels are respectively attached to said first and second platforms so that said pontoon is towable on land.

Other objects, advantages and features of the present invention will become more apparent upon reading of the following non-restrictive description of preferred embodiments thereof, given by way of example only with reference to the accompanying drawings.

BRIEF DESCRIPTION OF THE DRAWINGS

An embodiment of the present invention will now be disclosed, by way of example, in reference to the following drawings in which.

DETAILED DESCRIPTION

Figure 1:
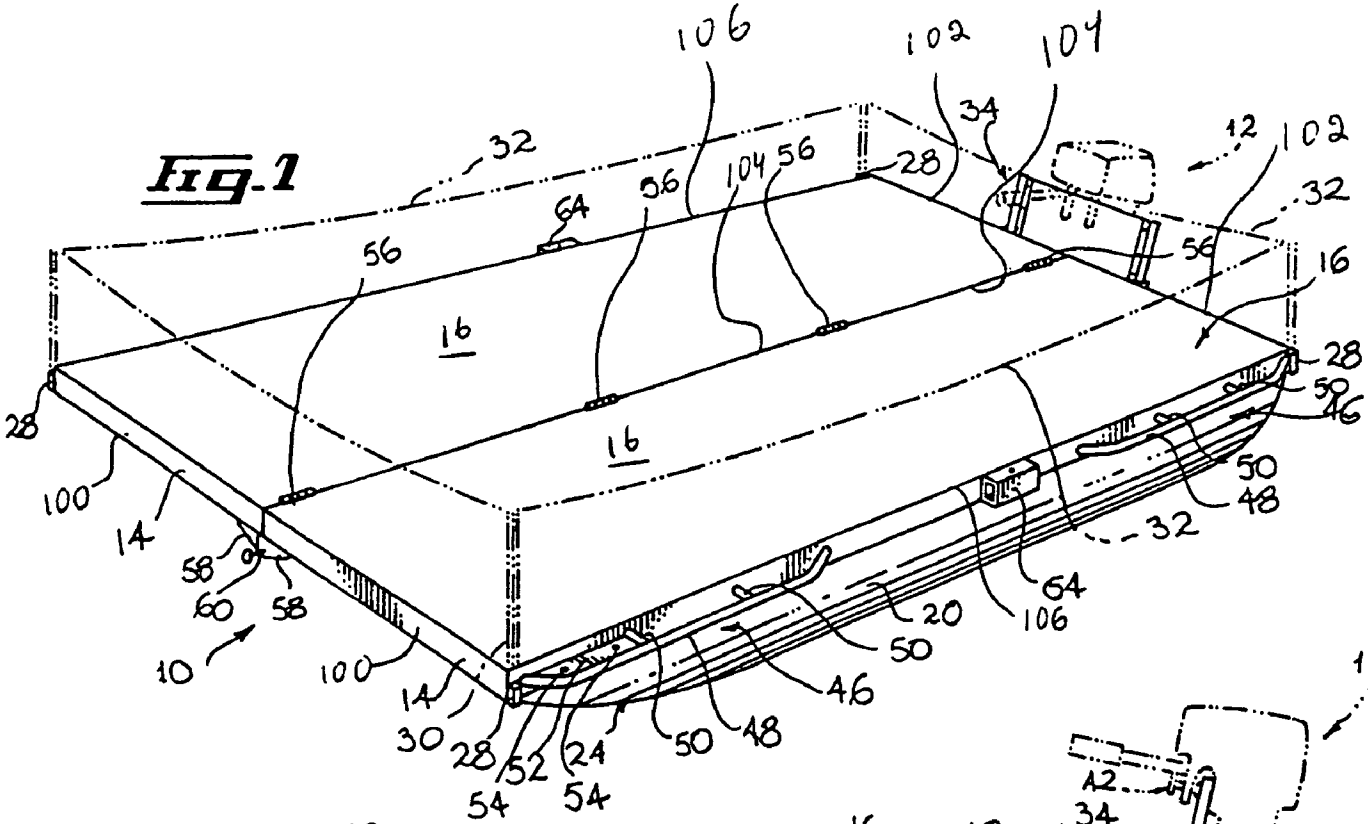
FIG. 1: in a perspective view, illustrates a pontoon in accordance with an embodiment of the present invention, the pontoon being shown in a deployed configuration and with a watercraft motor attached thereto, the watercraft motor being shown in phantom lines.

Referring to FIG. 1, there is shown a pontoon in accordance with an embodiment of the present invention, generally indicated by the reference numeral 10. The pontoon 10 is a pontoon trailer shown in a deployed configuration usable as a watercraft. The pontoon 10 is also shown with a marine propulsion motor 12 mounted thereon, the motor 12 being shown in phantom lines. It should however be understood that the pontoon 10 could be otherwise propelled by other types of motors, with paddles or oars, without departing from the scope of the present invention.

Figure 3:
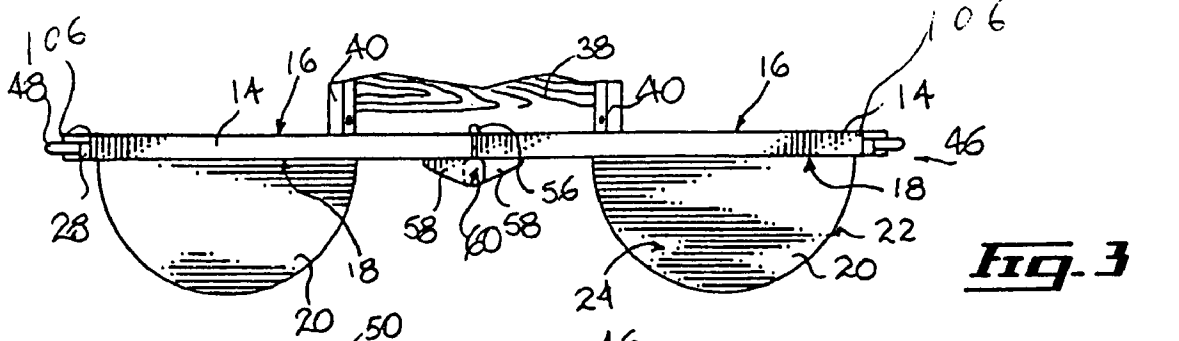
FIG. 3: in a front view with sections taken out, illustrates the pontoon shown in FIGS. 1 and 2.

As shown more specifically in FIGS. 3 through 7, the pontoon 10 includes a pair of platforms 14 each defining a corresponding substantially flat platform supporting surface 16 for supporting a load such as passengers, an ATV, gear and the like. Referring to FIG. 3, each platform 14 also defines a corresponding opposed platform buoyant body attachment surface 18 for attaching thereto a substantially buoyant body 20. It should be understood that the term "attached" refers generally to the fact that the buoyant body 20 extends from the pontoon attachment surface and that the buoyant body 20 could be formed integrally with the ladder without departing from the scope of the present invention. In the deployed configuration, the platforms 14 are substantially coplanar relatively to each other so as to be usable on water to support a load onto the platform supporting surfaces 16.

Returning to FIG. 1, each of the platforms 14 includes a platform first end edge 100, a platform second end edge 102 substantially opposed to the platform first end edge 100, a platform first lateral edge 104 extending between the platform first and second end edges 100 and 102 and a platform second lateral edge 106 substantially opposed to the platform first lateral edge 104 and extending between the first platform first and second end edges 100 and 102. The platform first and second end edges 100 and 102 and the platform first and second lateral edges 104 and 106 are located substantially peripherally relatively to the platform supporting and buoyant body attachment surfaces 16 and 18.

Figure 2:
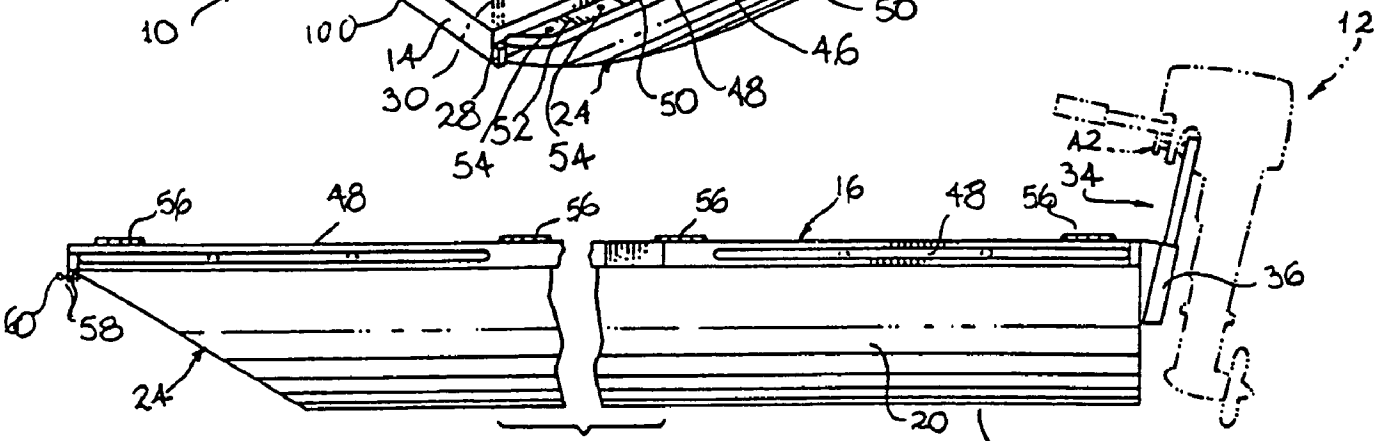
FIG. 2: in a side elevational view with sections taken out, illustrates the pontoon shown in FIG. 1.

The buoyant bodies 20 extend substantially outwardly from the platform buoyant body attachment surfaces 18 and are located substantially adjacent to the platform second lateral edges 106. In other words, the buoyant bodies 20 extend from the platform buoyant body attachment surfaces 18 substantially distally relative to a hinge interconnecting the platforms 14, as described in further details hereinbelow. This brings stability to the pontoon 10 when used as a watercraft . The buoyant bodies 20 each define a buoyant body outwardmost location 108 relatively to the platform buoyant body attachment surfaces 18, as seen in FIG. 2.

In the embodiment shown throughout the Figures, each buoyant body 20 has a cross-sectional configuration corresponding substantially to that of half of a circular disc. Accordingly, each buoyant body 20 typically has a substantially semicircular outer surface 22. Also, in order to improve the hydrodynamic characteristics of the watercraft formed by pontoon 10, each buoyant body 20 has a pontoon frontward surface 24 extending at an angle relatively to the corresponding platform 14 towards the corresponding platform second end edge 102. As shown more specifically in FIG. 2, the pontoon frontward surface 24 typically extends at an angle of approximately 45° relative to the corresponding platform 14. It should, however, be understood that the configuration of the pontoons 20 could vary without departing from the scope of the present invention.

Figure 4:
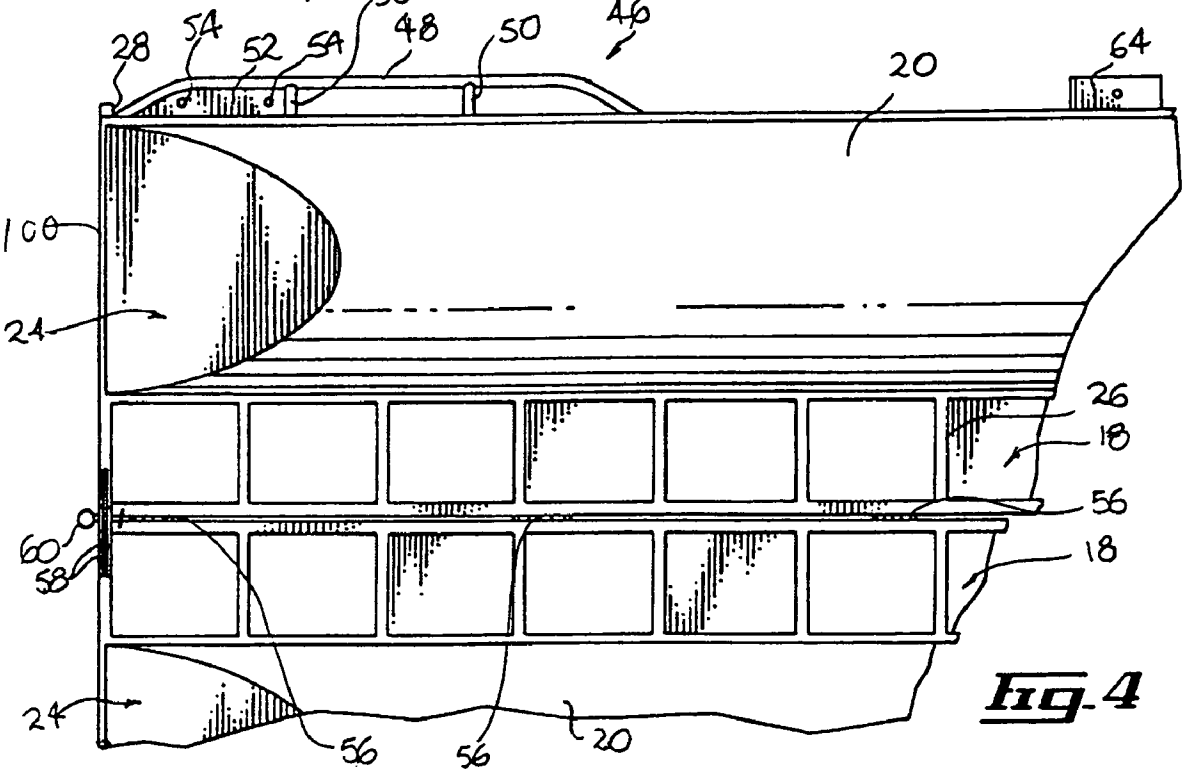
FIG. 4: in a partial bottom view with sections taken out, illustrates the pontoon shown in FIGS. 1 through 3.

As illustrated more specifically in FIG. 4, the pontoon supporting surface 18 of each platform 14 may be provided with reinforcements for reinforcing the structural integrity of the corresponding platform 14. In the embodiment shown throughout the Figures, the reinforcements include reinforcement ribs 26 extending from the platform buoyant body attachment surface 18. It should be understood that although the reinforcement ribs 26 are shown in FIG. 1 forming a substantially rectangular or square pattern, the reinforcement ribs 26 could be otherwise disposed without departing from the scope of the present invention. The reinforcement ribs 26 are hence adapted to increase the structural rigidity of the platform 14 without unduly increasing their respective weight.

As illustrated more specifically in FIG. 1, the pontoon 10 includes a cable attachment attachable to the platforms 14 and a delimiting cable 32 attachable to the cable attachment. For example, and non-limitingly, the platforms 14 are provided with post receiving sleeves 28 located about external corner sections thereof. In other words, the post receiving sleeves 28 are provided adjacent an intersection of the platform first end and second lateral edges 100 and 106 and an intersection of the platform second end and second lateral edges 102 and 106. The post receiving sleeves 28 are configured and sized for substantially fittingly receiving corresponding posts 30 thereinto. The posts 30 are adapted to be secured to corresponding post receiving sleeves 28 and to act as support for a delimiting cable 32 attached thereto. The delimiting cable 32 is, in turn, adapted to prevent or reduce the risks of cargo on the platforms 14 falling into the body of water on which the watercraft is traveling.

Figures 5, 6, 7:
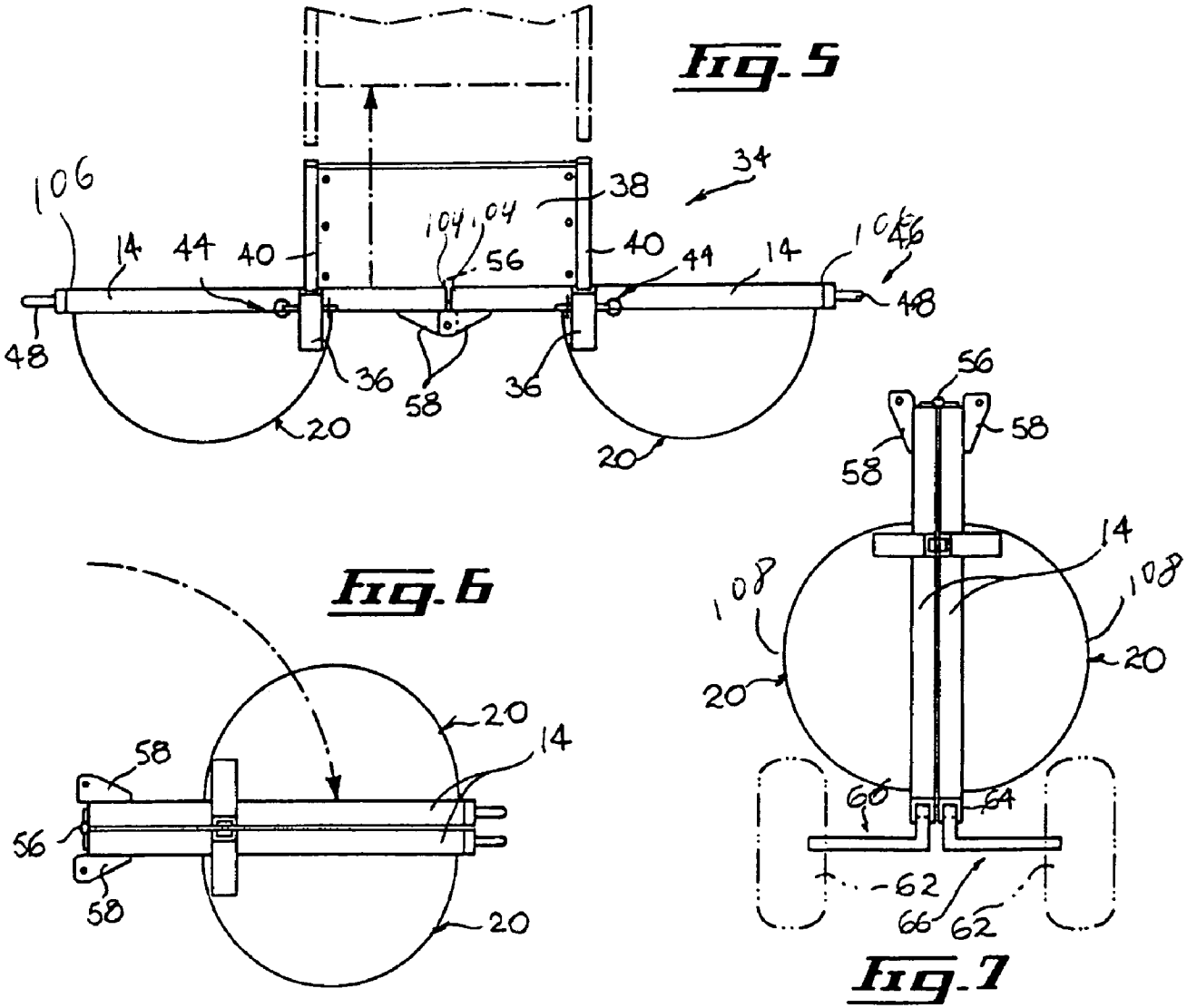
FIG. 5: in a rear view with sections taken out, illustrates the pontoon shown in FIGS. 1 and 2, the pontoon being shown with its motor supports being removed therefrom.
FIG. 6: in a rear view, illustrates the pontoon being folded towards it folded configuration.
FIG. 7: in a rear view, illustrates the pontoon being mounted on a set of wheels, the wheels being shown in phantom lines.

As illustrated more specifically in FIGS. 1, 2 and 5, the pontoon 10 is further provided with a motor attachment for allowing attachment of the motor 12 thereto. The motor attachment may take any suitable form.

In the embodiment shown throughout the Figures, the motor attachment 34 includes motor attachment sleeves 36 extending preferably at an angle, from the platform second end edges 102 of the platforms 14. The motor attachment also includes a motor attachment plate 38 extending between motor attachment posts 40. The motor 12 is mountable or attachable to the motor attachment plate 38 by conventional motor-to-supporting structure attachment means such as a conventional threaded jaw, illustrated in FIG. 2. The motor attachment plate 38 may take any suitable form, such as that of a plank, a stretched apart piece of flexible material, or the like.

As illustrated more specifically in FIG. 5, the motor attachment posts 40 are reversibly lockable to the motor attachment sleeves 36 using suitable post-to-sleeve attachments. In the embodiment shown in FIG. 5, the post-to-sleeve attachments include attachment pins 44 extending through corresponding apertures formed in both the sleeves 36 and posts 40. It should be understood that other sleeve-to-post attachments could be used without departing from the scope of the present invention. The general concept is that the motor attachment plate and post 38, 40 may be relatively easily and ergonomically retracted from the platforms 14 so as to allow folding thereof into the folded configuration shown in FIGS. 6 and 7, as will be hereinafter disclosed in greater detail.

The pontoon 10 is further provided with handling facilitators for facilitating handling thereof. In the embodiment shown throughout the Figures, the handling facilitators include handles 46 extending from the second platform lateral edges 106 of the platforms 14, typically adjacent to both the front and rearward ends thereof. The handles 46 may take any suitable form. Typically, the handles 46 include a handle bar 48 maintained in a spaced relationship relative to the second platform lateral edges 106 of the corresponding platform 14 and attached thereto by handle spacing rods 50. It should be understood that other types of handles could be used without departing from the scope of the present invention.

In the embodiment shown throughout the Figures, the handles 46 also act as a support for a tow bar attachment plate 52 extending between a segment of the handle bar 48 and a corresponding segment of the corresponding platform second lateral edge 106. The tow bar attachment plate 52 is typically located adjacent to the frontward end of the pontoon 10. The tow bar attachment plate 52 is typically provided with tow bar attachment apertures 54 extending therethrough for allowing attachment to a conventional tow bar, as will hereinafter be disclosed in greater details.

The platforms 14 are foldable relative to each other about the platform first lateral edge 104 thereof between a deployed, or expanded, configuration shown in FIGS. 1 through 5, and a retracted, or folded, configuration shown in FIGS. 6 through 10. In the deployed configuration, the pontoon 10 is usable as a watercraft, whereas in the folded configuration the pontoon 10 is usable on land. In the folded configuration, the platform supporting surfaces 16 are substantially facing each other.

The platforms 14 are hence hingedly attached together. Typically, the pontoon 10 includes a set of hinges 56 disposed along the adjacent lateral peripheral edge of the platforms 14. It should however be understood that the platforms may be hingedly attached together in any other suitable manner without departing from the scope of the present invention.

In some embodiments of the invention, the pontoon 10 is also provided with a platform lock for locking the platforms 14 in the deployed configuration. In the embodiment shown throughout the Figures, the lock includes locking tongues or plates 58 extending from the platforms 14 typically adjacent the platform end edges 100, 102 or both 100 and 102. The locking tongues 58 are configured, positioned and sized so that at least a portion thereof are in register with each other when the platforms 14 are in their deployed configuration. The locking tongues 58 are provided with a locking aperture for receiving a corresponding locking pin 60 thereinto so as to releasably lock the locking tongues 58 together, the locking tongues 56 being located, configured and sized such that the locking apertures are substantially in register relative to each other when the platforms are in the deployed configuration The pontoon trailer 10 is still further provided with wheel attachments for allowing attachment thereto of wheels 62 enabling the pontoon trailer 10 to be towed on land. The wheels 62 and associated wheel attachments may take any suitable form.

In the embodiment shown throughout the Figures, each wheel attachment includes a wheel attachment sleeve 64 extending from the platform second lateral edge 106 of each platform 14. The wheel attachment sleeve 64 is configured, sized and positioned for receiving a wheel attachment arm 66 to which the wheel 62 is rotatably attached. A wheel attachment arm 66 typically defines a substantially L-shaped arm spacing segment 68 and an arm attachment segment 70 extending therefrom. The wheel attachment segment 70 is substantially fittingly insertable into the wheel attachment sleeve 64. A suitable locking means such as a pin 72 and pin lock 74 combination is used for releasably attaching the wheel attachment arm 66 to the wheel attachment sleeve 64.

In some embodiments of the invention, the wheel attachment arms 66 are configured and sized such that the wheels 62 are substantially in register with the buoyant body outwardmost locations 108 when the platforms 14 are in the folded configuration and the wheels 62 are attached to the platforms 14. This brings compactness to the pontoon 10 while it is towed as the pontoon then has a relatively small width.

Figure 9:
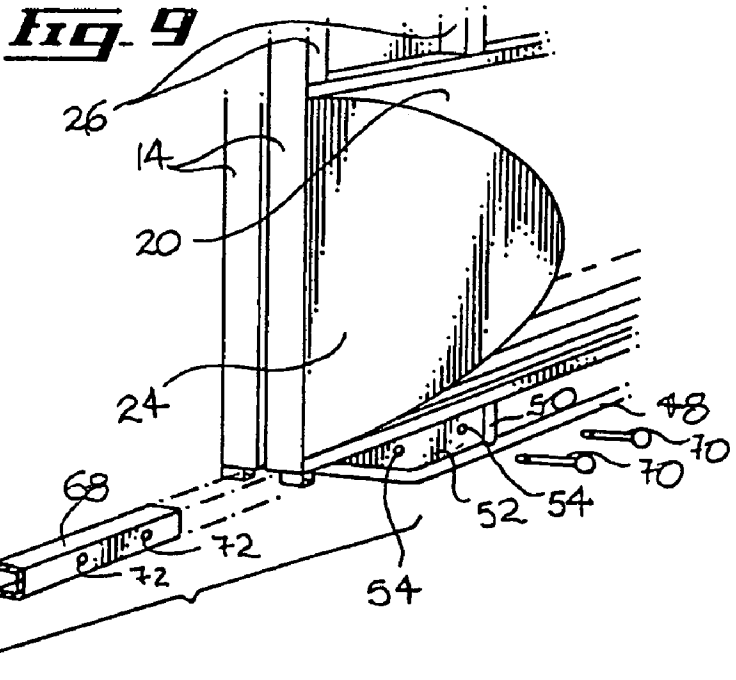
FIG. 9: in a partial perspective view, illustrates a hitch bar being attached to the pontoon.
Figure 8:
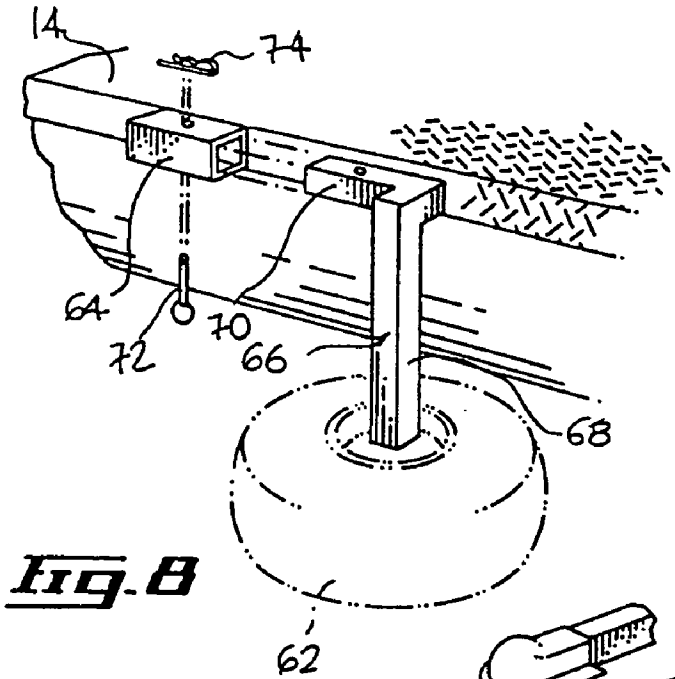
FIG. 8: in a partial perspective view, illustrates a wheel in its associated axle bracket being attached to the pontoon trailer.
Figure 10:
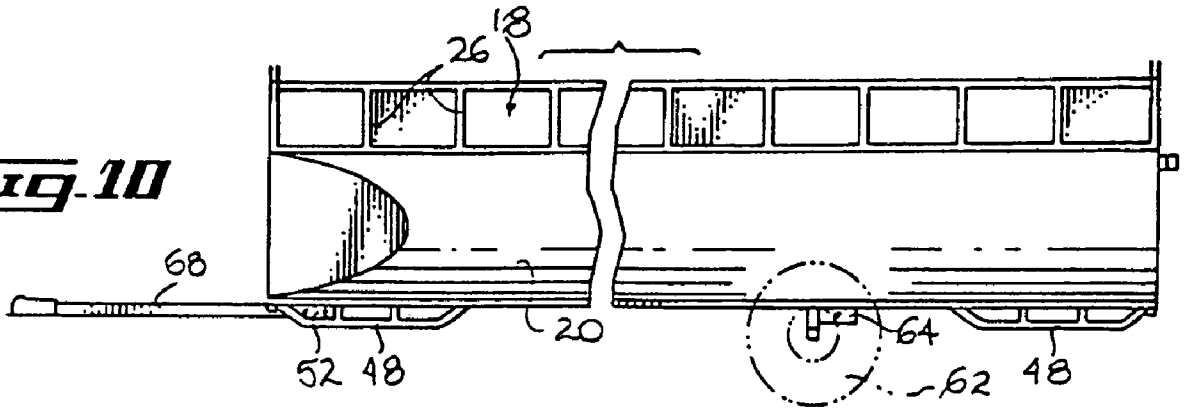
FIG. 10: in a partial side view with sections taken out, illustrates the pontoon in its folded configuration attachable to a conventional ATV.

As mentioned previously, the tow bar attachment plate 52 of each platform 14 is adapted to cooperate with the other tow bar attachment plate 52 for attaching a conventional tow bar 68 to the pontoon trailer 10 when the latter is in its folded configuration. As shown in FIG. 9, the tow bar attachment pins 70 are insertable into the tow bar attachment apertures 54 and the tow bar apertures 72 so as to releasably secure the tow bar 68 to the tow bar attachment plates 52.

In use, the pontoon trailer 10 may be relatively easily towed adjacent to a body of water when in its folded configuration. In the folded configuration, the pontoon 10 forms a substantially compact structure so as to be towable even in relatively dense vegetation. In addition, the positioning and configuration of the wheels ensure that the pontoon 10 is relatively stable as it has a relatively low center of gravity with its mass substantially entirely located between the wheels 62.

Having reached its aquatic destination, the pontoon 10 may be unfolded to its deployed configuration for use as a watercraft. In this configuration, the pontoon 10 is relatively stable and needs only a relatively small depth of water to be usable.

Therefore, the pontoon 10 is stable both on water and on land. This is caused at least in part through synergetic effects between the positioning of the wheels 62 and of the buoyant bodies 20.

Although the present invention has been described hereinabove by way of preferred embodiments thereof, it can be modified, without departing from the spirit and nature of the subject invention as defined in the appended claims.

What is claimed is:

1. A pontoon usable for supporting a load, said pontoon being towable on land and usable on water to support the load thereonto, said pontoon comprising:

a first platform including a first platform supporting surface, a first platform buoyant body attachment surface substantially opposed to said first platform supporting surface, a first platform first end edge, a first platform second end edge substantially opposed to said first platform first end edge, a first platform first lateral edge extending between said first platform first and second end edges and a first platform second lateral edge substantially opposed to said first platform first lateral edge and extending between said first platform first and second end edges, said first platform first and second end edges and said first platform first and second lateral edges being located substantially peripherally relatively to said first platform supporting and buoyant body attachment surfaces, said first platform further including a first substantially buoyant body extending substantially outwardly from said first platform buoyant body attachment surface and located substantially adjacent to said first platform second lateral edge, said first buoyant body defining a first buoyant body outwardmost location;

a second platform including a second platform supporting surface, a second platform buoyant body attachment surface substantially opposed to said second platform supporting surface, a second platform first end edge, a second platform second end edge substantially opposed to said second platform first end edge, a second platform first lateral edge extending between said second platform first and second end edges and a second platform second lateral edge substantially opposed to said second platform first lateral edge and extending between said second platform first and second end edges, said second platform first and second end edges and said second platform first and second lateral edges being located substantially peripherally relatively to said second platform supporting and buoyant body attachment surfaces, said second platform further including a second substantially buoyant body extending substantially outwardly from said second platform buoyant body attachment surface and located substantially adjacent to said second platform second lateral edge, said second buoyant body defining a second buoyant body outwardmost location, said first and second platform being hingedly attached to each other at locations respectively substantially adjacent said first and second platform first lateral edge;

a first and a second wheel respectively reversibly attachable to said first and second platforms respectively substantially adjacent said first and second platform second lateral edges;

said first and second platforms being movable between a deployed configuration and a folded configuration, wherein in said deployed configuration, said first and second wheels are detached from respectively said first and second platforms and said first and second platforms are substantially coplanar relatively to each other so as to be usable on water to support the load onto the first and second platform supporting surfaces; and in said folded configuration, said first platform supporting surface is substantially facing said second platform supporting surface and said first and second wheels are respectively attached to said first and second platforms so that said pontoon is towable on land;

said pontoon further comprising a lock for selectively locking said first and second platforms in said deployed configuration; said lock including a first locking tongue extending from said first platform substantially adjacent one of said first platform first and second end edges, said first locking tongue including a first locking aperture;

a second locking tongue extending from said second platform substantially adjacent one of said second platform first and second end edges that is substantially adjacent said one of said first platform first and second end edges, said second locking tongue including a second locking aperture;

a locking pin insertable into said first and second locking apertures said first and second locking tongues being located, configured and sized such that said first and second locking apertures are substantially in register relatively to each other when said first and second platforms are in said deployed configuration.

2. A pontoon as defined in claim 1, wherein said first and second buoyant bodies each have a cross-section corresponding substantially to that of half of a circular disc.

3. A pontoon as defined in claim 2, wherein said first and second buoyant bodies each include a body frontwardmost surface extending at an angle from respectively said first and second platform buoyant body attachment surfaces towards respectively said first and second platform second end edges.

4. A pontoon as defined in claim 1, wherein said first and second platforms each include at least one respective reinforcement rib extending respectively from said first and second platform buoyant body attachment surfaces.

5. A pontoon as defined in claim 4, wherein said first and second platforms each include a plurality of reinforcement ribs extending respectively from said first and second platform buoyant body attachment surfaces, said reinforcement ribs forming a substantially rectangular pattern.

6. A pontoon as defined in claim 1, further comprising a cable attachment attachable to said first and second platforms and a delimiting cable attachable to said cable attachment.

7. A pontoon as defined in claim 6, wherein said cable attachment includes first platform first and second receiving sleeves extending from said first platform respectively substantially adjacent an intersection of said first platform first end and second lateral edges and an intersection of said first platform second end and second lateral;

second platform first and second receiving sleeves extending from said second platform respectively substantially adjacent an intersection of said second platform first end and second lateral edges and an intersection of said second platform second end and second lateral; and at least four posts each fittingly receivable into a respective one of said first platform first and second receiving sleeves and said second platform first and second receiving sleeves;

said delimiting cable being attachable to said at least four posts.

8. A pontoon usable for supporting a load, said pontoon being towable on land and usable on water to support the load thereonto, said pontoon comprising:

a first platform including a first platform supporting surface, a first platform buoyant body attachment surface substantially opposed to said first platform supporting surface, a first platform first end edge, a first platform second end edge substantially opposed to said first platform first end edge, a first platform first lateral edge extending between said first platform first and second end edges and a first platform second lateral edge substantially opposed to said first platform first lateral edge and extending between said first platform first and second end edges, said first platform first and second end edges and said first platform first and second lateral edges being located substantially peripherally relatively to said first platform supporting and buoyant body attachment surfaces, said first platform further including a first substantially buoyant body extending substantially outwardly from said first platform buoyant body attachment surface and located substantially adjacent to said first platform second lateral edge, said first buoyant body defining a first buoyant body outwardmost location;

a second platform including a second platform supporting surface, a second platform buoyant body attachment surface substantially opposed to said second platform supporting surface, a second platform first end edge, a second platform second end edge substantially opposed to said second platform first end edge, a second platform first lateral edge extending between said second platform first and second end edges and a second platform second lateral edge substantially opposed to said second platform first lateral edge and extending between said second platform first and second end edges, said second platform first and second end edges and said second platform first and second lateral edges being located substantially peripherally relatively to said second platform supporting and buoyant body attachment surfaces, said second platform further including a second substantially buoyant body extending substantially outwardly from said second platform buoyant body attachment surface and located substantially adjacent to said second platform second lateral edge, said second buoyant body defining a second buoyant body outwardmost location, said first and second platform being hingedly attached to each other at locations respectively substantially adjacent said first and second platform first lateral edge;

a first and a second wheel respectively reversibly attachable to said first and second platforms respectively substantially adjacent said first and second platform second lateral edges;

said first and second platforms being movable between a deployed configuration and a folded configuration, wherein in said deployed configuration, said first and second wheels are detached from respectively said first and second platforms and said first and second platforms are substantially coplanar relatively to each other so as to be usable on water to support the load onto the first and second platform supporting surfaces; and in said folded configuration, said first platform supporting surface is substantially facing said second platform supporting surface and said first and second wheels are respectively attached to said first and second platforms so that said pontoon is towable on land; said pontoon being usable with a motor, said pontoon further comprising a motor attachment extending from at least one of said first and second platforms for attaching the motor thereto; said motor attachment including a first motor attachment sleeve extending from said first platform substantially adjacent said first platform second end;

a first motor attachment post insertable and reversibly lockable into said first motor attachment sleeve;

a second motor attachment sleeve extending from said second platform substantially adjacent said second platform second end;

a second motor attachment post insertable and reversibly lockable into said second motor attachment sleeve; and a motor attachment plate for attaching the motor thereto, said motor attachment plate being attached to said first and second motor attachment posts.

9. A pontoon as defined in claim 8, wherein said motor attachment extends from both said first and second platforms at locations substantially adjacent said first and second platforms second end edges.

10. A pontoon as defined in claim 8, further comprising a first handle extending from said first platform second lateral edge and a second handle extending from said second platform second lateral edge.

11. A pontoon as defined in claim 10, wherein said first and second handles each include a tow bar attachment for attaching a tow bar thereto.

12. A pontoon usable for supporting a load, said pontoon being towable on land and usable on water to support the load thereonto, said pontoon comprising:

a first platform including a first platform supporting surface, a first platform buoyant body attachment surface substantially opposed to said first platform supporting surface, a first platform first end edge, a first platform second end edge substantially opposed to said first platform first end edge, a first platform first lateral edge extending between said first platform first and second end edges and a first platform second lateral edge substantially opposed to said first platform first lateral edge and extending between said first platform first and second end edges, said first platform first and second end edges and said first platform first and second lateral edges being located substantially peripherally relatively to said first platform supporting and buoyant body attachment surfaces, said first platform further including a first substantially buoyant body extending substantially outwardly from said first platform buoyant body attachment surface and located substantially adjacent to said first platform second lateral edge, said first buoyant body defining a first buoyant body outwardmost location;

a second platform including a second platform supporting surface, a second platform buoyant body attachment surface substantially opposed to said second platform supporting surface, a second platform first end edge, a second platform second end edge substantially opposed to said second platform first end edge, a second platform first lateral edge extending between said second platform first and second end edges and a second platform second lateral edge substantially opposed to said second platform first lateral edge and extending between said second platform first and second end edges, said second platform first and second end edges and said second platform first and second lateral edges being located substantially peripherally relatively to said second platform supporting and buoyant body attachment surfaces, said second platform further including a second substantially buoyant body extending substantially outwardly from said second platform buoyant body attachment surface and located substantially adjacent to said second platform second lateral edge, said second buoyant body defining a second buoyant body outwardmost location, said first and second platform being hingedly attached to each other at locations respectively substantially adjacent said first and second platform first lateral edge;

a first and a second wheel respectively reversibly attachable to said first and second platforms respectively substantially adjacent said first and second platform second lateral edges;

said first and second platforms being movable between a deployed configuration and a folded configuration, wherein in said deployed configuration, said first and second wheels are detached from respectively said first and second platforms and said first and second platforms are substantially coplanar relatively to each other so as to be usable on water to support the load onto the first and second platform supporting surfaces; and in said folded configuration, said first platform supporting surface is substantially facing said second platform supporting surface and said first and second wheels are respectively attached to said first and second platforms so that said pontoon is towable on land; said pontoon, further comprising first and second wheel attachments for attaching respectively said first and second wheels to respectively said first and second platforms; wherein said first wheel attachment includes a first wheel attachment arm to which said first wheel is rotatably mounted, said first wheel attachment arm being reversibly attachable to said first platform; and said second wheel attachment includes a second wheel attachment arm to which said second wheel is rotatably mounted, said second wheel attachment arm being reversibly attachable to said second platform.

13. A pontoon as defined in claim 12, wherein said first and second wheel attachment arms are configured and sized such that said first and second wheel are substantially in register respectively with said first and second buoyant body outwardmost locations when said first and second platforms are in said folded configuration and said first and second wheels are attached to said first and second platforms.

14. A pontoon as defined in claim 12, wherein said first wheel attachment includes a first wheel attachment sleeve extending from said first platform at a location substantially adjacent said first platform second lateral edge, said first wheel attachment arm being insertable and reversibly lockable into said first wheel attachment sleeve;

said second wheel attachment includes a second wheel attachment sleeve extending from said second platform at a location substantially adjacent said second platform second lateral edge, said second wheel attachment arm being insertable and reversibly lockable into said second wheel attachment sleeve.

15. A pontoon as defined in claim 12, wherein said first and second attachment arms are substantially L-shaped.

* * * * *